US010688339B2

(12) United States Patent
Sasaki et al.

(10) Patent No.: US 10,688,339 B2
(45) Date of Patent: Jun. 23, 2020

(54) BALANCE TRAINING APPARATUS AND CONTROL METHOD FOR BALANCE TRAINING APPARATUS

(71) Applicant: TOYOTA JIDOSHA KABUSHIKI KAISHA, Toyota-shi, Aichi-ken (JP)

(72) Inventors: Yu Sasaki, Toyota (JP); Masahiro Takahashi, Nagakute (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 360 days.

(21) Appl. No.: 15/869,527

(22) Filed: Jan. 12, 2018

(65) Prior Publication Data

US 2018/0229074 A1 Aug. 16, 2018

(30) Foreign Application Priority Data

Feb. 16, 2017 (JP) ..... 2017-027001

(51) Int. Cl.
*A63B 22/00* (2006.01)
*A63B 22/16* (2006.01)
*A63B 24/00* (2006.01)

(52) U.S. Cl.
CPC ..... *A63B 22/16* (2013.01); *A63B 24/0006* (2013.01); *A63B 2024/009* (2013.01)

(58) Field of Classification Search
None
See application file for complete search history.

(56) References Cited

U.S. PATENT DOCUMENTS 6,949,024 B2 * 9/2005 Kaku ..... A63F 13/10 463/31
2001/0049300 A1 * 12/2001 Okamoto ..... A63F 13/10 463/30
2006/0105838 A1 * 5/2006 Mullen ..... A63F 13/25 463/31
2010/0151948 A1 * 6/2010 Vance ..... A63F 13/06 463/43
2012/0069131 A1 * 3/2012 Abelow ..... G06Q 10/067 348/14.01

FOREIGN PATENT DOCUMENTS

JP 2016-73386 A 5/2016

* cited by examiner

*Primary Examiner* — Paul A D'Agostino
(74) *Attorney, Agent, or Firm* — Sughrue Mion, PLLC

(57) ABSTRACT

Provided is a balance training apparatus operating in conjunction with an inverted pendulum moving apparatus on which a trainee rides and performs a moving operation. The balance training apparatus includes a detector configured to detect a position of the moving apparatus, and a controller configured to set a task for the trainee to travel back and forth from an initial position to a target position within a predetermined time and configured to superimpose a character representing the trainee at a position corresponding to a position of the moving apparatus on a video indicating progress of the task and display it on a display. The controller corrects the initial position in a task to be executed next to a position of the moving apparatus at the end of a task that has been executed last and corrects the target position according to the correction of the initial position.

5 Claims, 19 Drawing Sheets

TASK LIST

| TASK NUMBER | $H_1$ | $H_2$ | $H_3$ | ... | $H_n$ |
|---|---|---|---|---|---|
| DISTANCE | $D_1$ | $D_2$ | $D_3$ | ... | $D_n$ |
| DIRECTION | + | − | + | ... | − |

Fig. 7 mTH TASK AND RESULT
OF CARRY IT OUT

ACTUAL MOVEMENT DISTANCE
$2D_m$-DL

SCHEDULED m+1TH TASK

TARGET MOVEMENT DISTANCE
$2D_{m+1}$

CORRECTED m+1TH TASK

TARGET MOVEMENT DISTANCE
$2D_{m+1}+DL$ mTH TASK AND RESULT
OF CARRY IT OUT

ACTUAL MOVEMENT DISTANCE
$2D_m$-DL

SCHEDULED m+1TH TASK

TARGET MOVEMENT DISTANCE
$2D_{m+1}$

CORRECTED m+1TH TASK

TARGET MOVEMENT DISTANCE
$2D_{m+1}-DL$

CORRECTED m+1TH TASK

TARGET MOVEMENT DISTANCE
$2D_{m+1}$ mTH TASK AND RESULT
OF CARRY IT OUT

ACTUAL MOVEMENT DISTANCE
$2D_m$-DL'

CORRECTED m+1TH TASK

TARGET MOVEMENT DISTANCE
$2D_{m+1}+DL'$

RE-CORRECTED m+1TH TASK

TARGET MOVEMENT DISTANCE
$2D_{m+1}+DL'-2DW$

BALANCE TRAINING APPARATUS AND CONTROL METHOD FOR BALANCE TRAINING APPARATUS

CROSS REFERENCE TO RELATED APPLICATIONS

This application is based upon and claims the benefit of priority from Japanese patent application No. 2017-027001, filed on Feb. 16, 2017, the disclosure of which is incorporated herein in its entirety by reference.

BACKGROUND

The present disclosure relates to a balance training apparatus and a control method for the balance training apparatus.

A balance training apparatus is known which allows an occupant, who is a trainee, to learn how to move his/her center of gravity necessary for walking by making him/her to move an inverted pendulum moving apparatus so that it travels while maintaining his/her balance. See, for example, Japanese Unexamined Patent Application Publication No. 2016-73386. Training may be performed by linking movements of a moving apparatus to movements of a character displayed on a display device and having the trainee carry out game-like tasks that are given on the display device. The trainee achieves a certain training effect by continuously trying to carry out such tasks.

SUMMARY

It is difficult to enlarge a range in which an inverted pendulum moving apparatus can be moved due to its relation with a size of the entire balance training apparatus. Therefore, the individual tasks are configured in such a way that the moving apparatus starts moving from an initial position and then returns to the initial position. Therefore, even if the moving apparatus has not returned to the initial position when the task that has been executed last is ended, the next task is given on the assumption that the moving apparatus starts moving from the initial position. Since an occupant of the moving apparatus is a trainee who needs balance training, he/she often fails to return the moving apparatus to the initial position properly. In such a case, it may be more difficult for the occupant to handle the next task. If the trainee cannot handle the task, he/she will be less motivated to do the task, and thus an expected training effect will not be achieved.

The present disclosure has been made to solve such a problem. The present disclosure provides a balance training apparatus that maintains the trainee's motivation for carrying out the tasks and promises to achieve a high training effect.

A first example aspect of the present disclosure is a balance training apparatus operating in conjunction with an inverted pendulum moving apparatus on which a trainee rides and performs a moving operation. The balance training apparatus includes: a detector configured to detect a position of the moving apparatus; and a controller configured to set a task for the trainee to travel back and forth from an initial position to a target position within a predetermined time and configured to display, on a display, a character representing the trainee at a position corresponding to a position of the moving apparatus superimposed on a video indicating progress of the task. The controller corrects the initial position in a task to be executed next to a position of the moving apparatus at the end of a task that has been executed last and corrects the target position according to the correction of the initial position.

In this way, as the initial position and the target position of the task that has been executed last are corrected according to the position of the moving apparatus at the end of the task that has been executed last, it is more likely that the trainee can achieve the task to be executed next and less likely that he/she is less motivated to try to carry out the task. Moreover, as the originally set task is corrected instead of changing the next task to an easy one, the difficulty level can be maintained at a certain level, and it can be expected that a high training effect is achieved.

In the balance training apparatus, when there is an insufficiency in a reciprocating movement distance targeted by the task due to the correction of the initial position, the controller makes an adjustment in a task executed after the task in which the insufficiency is generated from among the tasks consecutively given in one task game in such a way that a load on the trainee will become large. By adjusting the subsequent task in this way, an effect close to an originally expected training effect can be achieved.

Further, the controller adjusts a score given to achievement of the task based on the correction of the initial position and displays the score on the display. In a task-style training whereby a character is displayed on the display, the score given according to the degree of achievement not only contributes to improving motivation but also serves as an index for objectively evaluating an amount of the training. Accordingly, the score thus adjusted can be used as the index for more accurately evaluating the amount of the training.

Further, when the position of the moving apparatus at the end of the task that has been executed last is within a predetermined distance from the initial position, the controller does not correct the initial position of the task to be executed next. By simplifying the process in this manner, it is possible to reduce a load on the controller.

A second example aspect of the present disclosure is a control method of a balance training apparatus operating in conjunction with an inverted pendulum moving apparatus on which a trainee rides and performs a moving operation. The control method includes: setting a first task and a second task for the trainee to travel back and forth from an initial position to a target position within a predetermined time; displaying, on a display, a character representing the trainee at a position corresponding to a position of the moving apparatus superimposed on a video indicating progress of the first task after the first task is started; and correcting the initial position in the second task to a position of the moving apparatus at the end of the first task and correcting the target position in the second task according to the correction of the initial position.

In this way, as the initial position and the target position of the second task are corrected according to the position of the moving apparatus at the end of the first task, it is more likely that the trainee can achieve the second task and less likely that he/she is less motivated to try to carry out the task. Moreover, as the originally set task is corrected instead of changing the second task to an easy one, the difficulty level can be maintained at a certain level, and it can be expected that a high training effect is achieved.

According to the present disclosure, it is possible to provide a balance training apparatus that maintains the trainee's motivation for carrying out the tasks and promises to achieve a high training effect.

The above and other objects, features and advantages of the present invention will become more fully understood from the detailed description given hereinbelow and the accompanying drawings which are given by way of illustration only, and thus are not to be considered as limiting the present invention.

BRIEF DESCRIPTION OF DRAWINGS

FIG. 7 is a diagram for describing a task list;

DESCRIPTION OF EMBODIMENTS

Hereinafter, although the present disclosure will be described with reference to embodiments of the invention, the present disclosure according to claims is not limited to the following embodiments. Moreover, all the components described in the following embodiments are not necessarily indispensable for means to solve problems.

Figure 1:
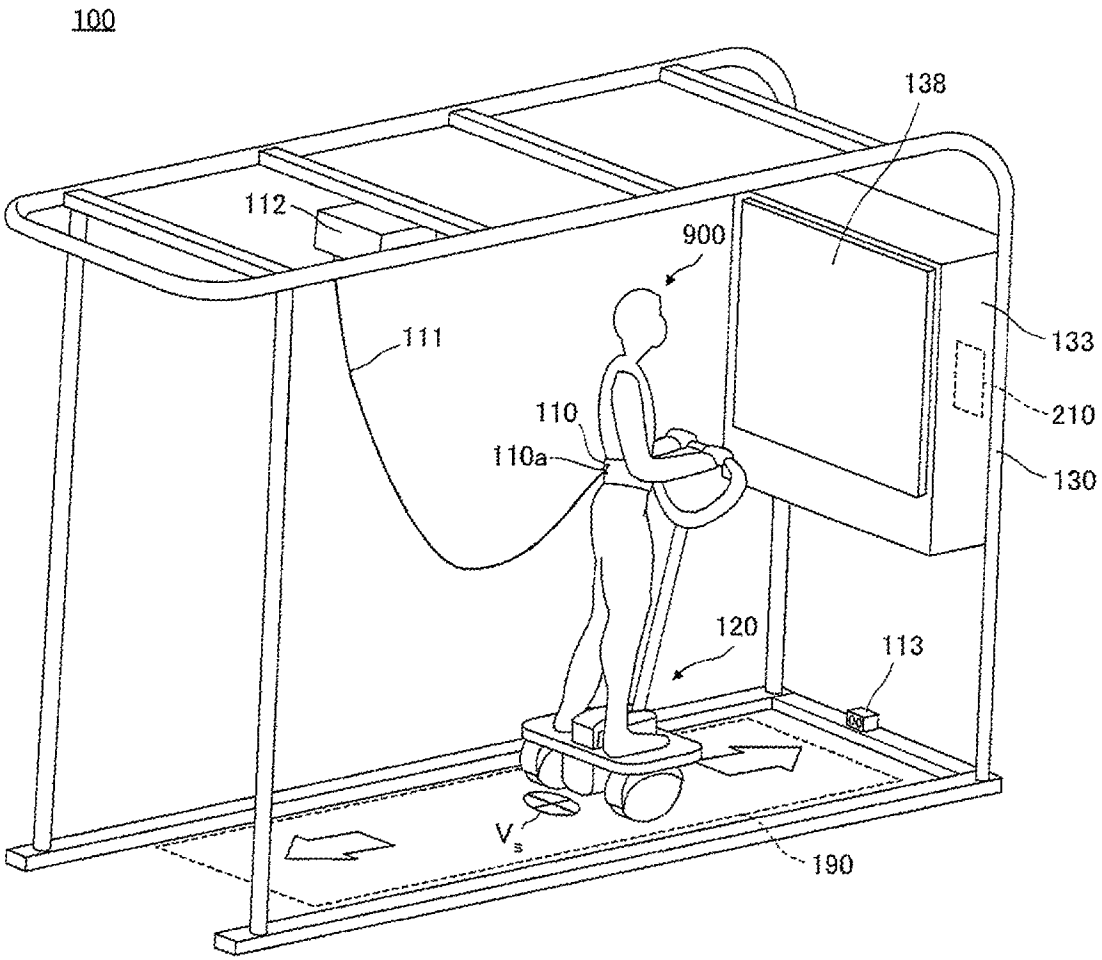
FIG. 1 is a schematic perspective view of a balance training apparatus according to an embodiment.

FIG. 1 is a schematic perspective view of a training apparatus 100 as an example of a balance training apparatus according to this embodiment. The training apparatus 100 is an apparatus for a person with a disability such as hemiplegia to learn how to move his/her center of gravity necessary for walking and for a patient with a disability in his/her foot joints to recover his/her foot joint function. The training apparatus 100 includes a moving apparatus 120 that operates in conjunction with it. For example, when a trainee 900 who wishes to recover his/her foot joint function intends to continue riding on the moving apparatus 120 while maintaining his/her balance, the moving apparatus 120 can give a load that promises to provide an rehabilitation effect to the trainee 900's foot joints.

The training apparatus 100 mainly includes a control panel 133 attached to a frame 130 constituting an entire framework, a harness pulling unit 112, and the moving apparatus 120 on which the trainee 900 is to ride.

The trainee 900 or an operator moves the moving apparatus 120 to a traveling surface surrounded by the frame 130 and then conducts training. On the traveling surface, a movement limited range 190 is set as a normal movement range of the moving apparatus 120. Further, an initial position Vs is set near the center of the movement limited range 190. The initial position Vs is a reference position of the moving apparatus 120. The initial position Vs is marked on a floor surface or the like so that the trainee 900 and the like can recognize it. Likewise, the movement limited range 190 is preferably marked on the floor surface or the like so that the trainee 900 and the like can recognize it.

The frame 130 supports the control panel 133, a display unit 138, and the like. The control panel 133 accommodates an overall control unit 210 that controls motors and sensors. The display unit 138 is, for example, a liquid crystal panel that displays progress and the like of the training. The frame 130 further supports the harness pulling unit 112 near above the trainee 900's head.

The training apparatus 100 includes a harness apparatus as a safety apparatus. The harness apparatus is mainly composed of a brace 110, a harness wire 111, and the harness pulling unit 112. The harness apparatus supports the trainee 900's upper body when he/she is about to lose his/her balance in order to keep the trainee 900 safe. The brace 110 is a belt wrapped around the trainee 900's waist and is fixed to the trainee 900's lower back by, for example, a hook and loop fastener. One end of the harness wire 111 is connected to the brace 110, and the other end is connected to a winding mechanism of the harness pulling unit 112. The winding mechanism of the harness pulling unit 112 winds and unwinds the harness wire 111 by turning on and off a motor (not shown).

The moving apparatus 120 is a coaxial two-wheeled vehicle that moves while maintaining its posture based on a posture control model of an inverted pendulum. The moving apparatus 120 is also an inverted moving training apparatus that operates in conjunction with the training apparatus 100. The position of the moving apparatus 120 is detected by a position sensor 113 mounted on the frame 130. The position sensor 113 is, for example, a laser rangefinder or an ultrasonic sensor. In this embodiment, the position sensor 113 detects a one-dimensional position of the moving apparatus 120 in the direction indicated by the arrow within the movement limited range 190. However, the position sensor 113 may further detect a two-dimensional position and an amount of rotation of the moving apparatus 120.

Figure 2:
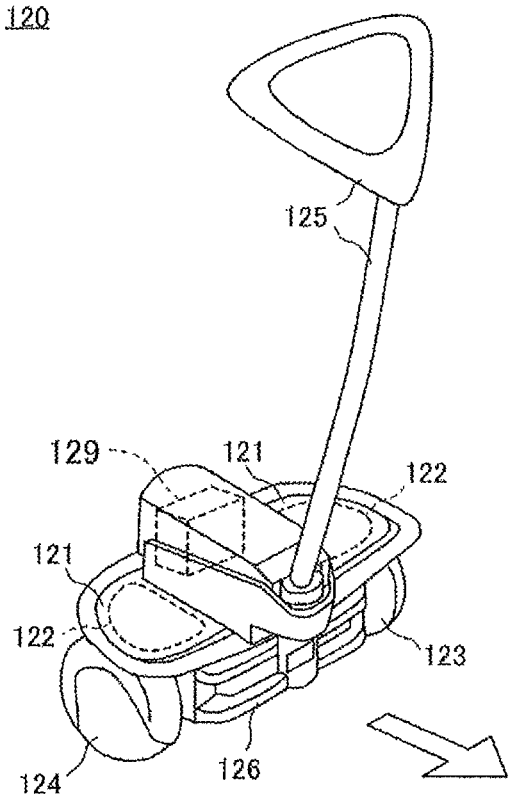
FIG. 2 is a schematic perspective view of a moving apparatus.

FIG. 2 is a schematic perspective view of the moving apparatus 120. The moving apparatus 120 is composed of bases 126 constituting an entire framework, right and left boarding steps 121 extending laterally, a left driving wheel 123, a right driving wheel 124, and a steering wheel unit 125.

The steering wheel unit 125 serves a function as a support for the trainee 900 to maintain his/her balance and also serves a function as an instruction reception unit for instructing the moving apparatus 120 to travel forward or turn. More specifically, when the trainee 900 tilts the steering wheel unit 125 forward, the moving apparatus 120 travels forward, while when the trainee 900 tilts the steering wheel unit 125 backward, the moving apparatus 120 travels backward. Likewise, when the trainee 900 tilts the steering wheel unit 125 to the left with respect to the traveling direction, the moving apparatus 120 is turned to the left, while when the trainee 900 tilts the steering wheel unit 125 to the right with respect to the traveling direction, the moving apparatus 120 is turned to the right. In the tasks described later, the trainee 900 moves the moving apparatus 120 forward or backward but he/she does not turn the moving apparatus 120. For this reason, the moving apparatus 120 may not be provided with the turning function.

The left driving wheel 123 is attached offset to the left with respect to the middle of the left and right boarding steps 121, and is rotationally driven by a motor (not shown). The right driving wheel 124 is attached offset to the right with respect to the middle of the left and right boarding steps 121, and is rotationally driven by a motor (not shown). The left driving wheel 123 and the right driving wheel 124 are arranged in parallel on the coaxial core wire. Thus, the moving apparatus 120 moves straight if the left driving wheel 123 and the right driving wheel 124 are rotated at the same rotation speed in the same direction, while it turns to the left or right if the left driving wheel 123 and the right driving wheel 124 are rotated at different speeds. A moving body control unit described later detects an entire posture of the moving apparatus 120 on which the trainee 900 has ridden and controls the rotation of the left driving wheel 123 and the right driving wheel 124 so as to stably maintain the state of the moving apparatus 120 on which the trainee 900 is riding.

A load sensor 122 is embedded in each of the left and right boarding steps 121. The load sensors 122 detect loads of the trainee 900's right and left legs, respectively. A battery 129 supplies electric power necessary for operating the moving apparatus 120. The battery 129 is, for example, a lithium-ion battery and can be repeatedly used by charging it.

Figure 3:
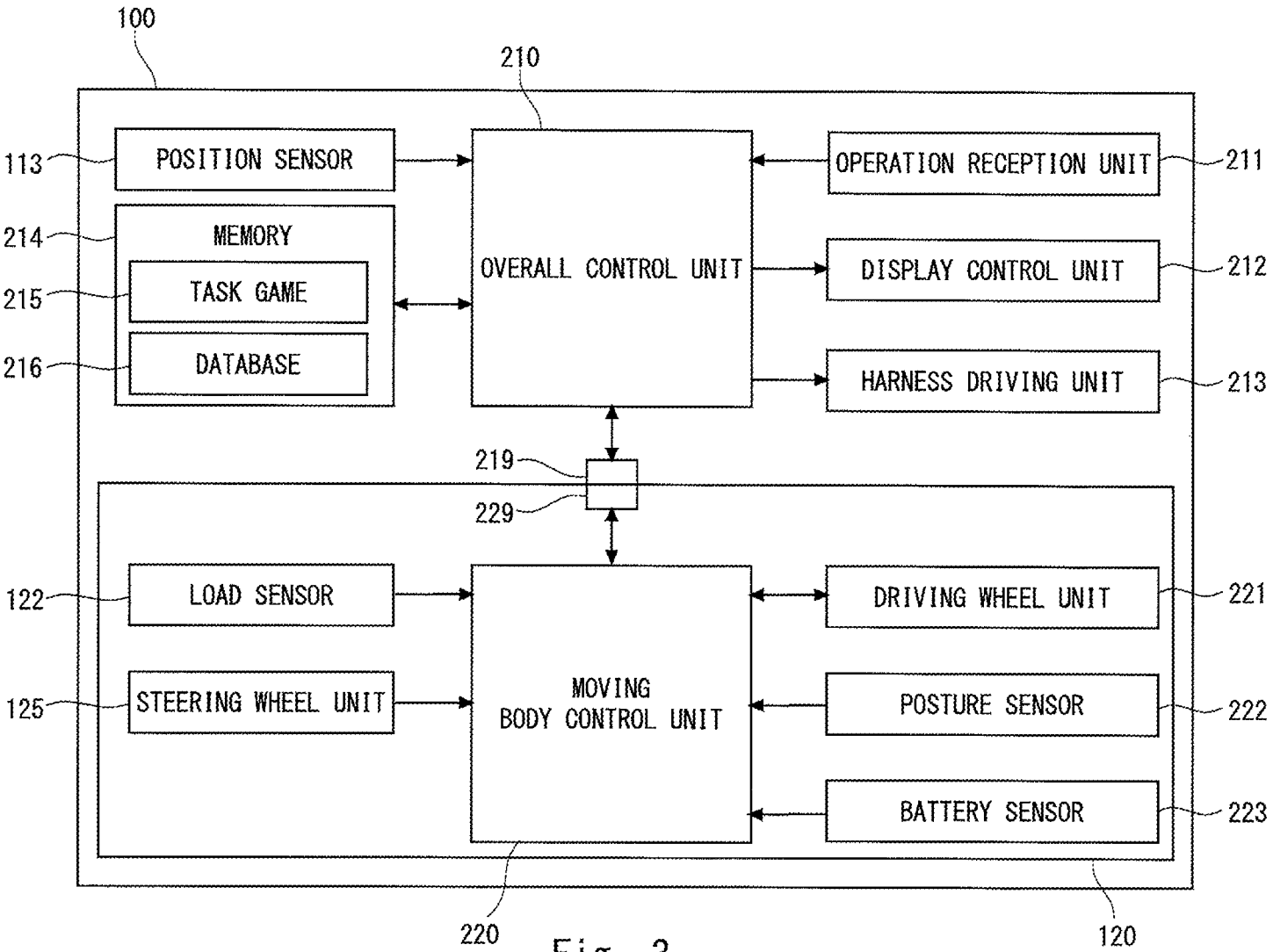
FIG. 3 is a diagram showing a system configuration of the balance training apparatus.

Next, a system configuration of the training apparatus 100 will be described. FIG. 3 is a system configuration diagram of the training apparatus 100. The overall control unit 210 is, for example, a CPU. The overall control unit 210 executes a control program read from a memory 214 to thereby execute control on the entire apparatus. The operation reception unit 211 receives an input operation from the trainee 900 or the operator and transmits an operation signal to the overall control unit 210. The trainee 900 or the operator operates operation buttons or a touch panel provided in the apparatus or an attached remote controller, which constitute the operation reception unit 211, in order to give an instruction to turn on/off the power, input numerical values related to configurations, or to select a menu item.

The display control unit 212 generates a graphic video and the like of a task game, which will be described later, in accordance with a display signal from the overall control unit 210, and displays them on the display unit 138. A harness driving unit 213 includes a motor and a driving circuit for the motor. This motor is for pulling the harness wire 111 constituting the harness pulling unit 112. The overall control unit 210 transmits a driving signal to the harness driving unit 213 to thereby control the winding of the harness wire 111 and the pulling force of the harness wire 111.

The position sensor 113 transmits the detected position of the moving apparatus 120 to the overall control unit 210. The memory 214 is a non-volatile storage medium. For example, a solid state drive is used for the memory 214. The memory 214 stores a control program and the like for controlling the training apparatus 100. In particular, the memory 214 stores a task game 215. The task game 215 is a program for giving consecutive game-style tasks so that the trainee 900 can train pleasantly. The memory 214 further stores a database 216 that manages various parameter values, functions, lookup tables, and the like used for control.

As described above, the moving apparatus 120 travels on the traveling surface surrounded by the frame 130. The training apparatus 100 includes a communication connection IF 219 connected to the overall control unit 210 in order to give commands to the moving apparatus 120 and to receive sensor information. The moving apparatus 120 also includes a communication connection IF 229 connected to the communication connection IF 219 by a wired or wireless connection. The communication connection IF 229 is connected to the moving body control unit 220 of the moving apparatus 120. The communication connection IFs 219 and 229 are communication interfaces such as a wireless LAN or the like conforming to the communication standard.

The moving body control unit 220 is, for example, a CPU. The moving body control unit 220 executes a control program provided from the overall control unit 210 to thereby control the moving apparatus 120. The moving body control unit 220 notifies the overall control unit 210 of the state of the moving apparatus 120 via the communication connection IFs 219 and 229. The moving body control unit 220 executes activation/deactivation etc. of the moving apparatus 120 in response to a command from the overall control unit 210.

A driving wheel unit 221 includes a driving circuit and a motor for driving the left driving wheel 123 and the right driving wheel 124. The moving body control unit 220 transmits a driving signal to the driving wheel unit 221 to thereby control the rotation of the left driving wheel 123 and the right driving wheel 124.

A posture sensor 222 includes an acceleration sensor and a gyro sensor. The posture sensor 222 transmits detection signals to the moving body control unit 220 in response to a request signal from the moving body control unit 220. The moving body control unit 220 recognizes an inverted state of the moving apparatus 120 from these detection signals, generates a driving signal necessary for maintaining the inverted state, and transmits the driving signal to the driving wheel unit 221.

A battery sensor 223 includes a remaining capacity sensor for detecting a remaining capacity of the battery 129 and a temperature sensor for monitoring the temperature of the battery 129. The battery sensor 223 transmits various detection results of the battery 129 including the remaining capacity and temperature to the moving body control unit 220.

The load sensors 122 detect that the trainee 900 has ridden on the moving apparatus 120 and transmit a detection signal to the moving body control unit 220. In response to receiving the detection signal, the moving body control unit 220 recognizes that the occupant has ridden on the moving apparatus 120 and starts to control the posture of the inverted pendulum.

The steering wheel unit 125 includes an angle sensor provided on a pivotally supported part that is pivotally supported by the bases 126. The steering wheel unit 125 transmits a tilting direction and an angle detected by the angle sensor to the moving body control unit 220 as a detection signal.

In this embodiment, the trainee 900 is encouraged to conduct training by executing the task game 215. The task game 215 processed by the overall control unit 210 generates a graphic video that changes by the second and displays it on the display unit 138. The trainee 900 is encouraged by the video to perform an operation to move the moving apparatus 120.

Figure 4:
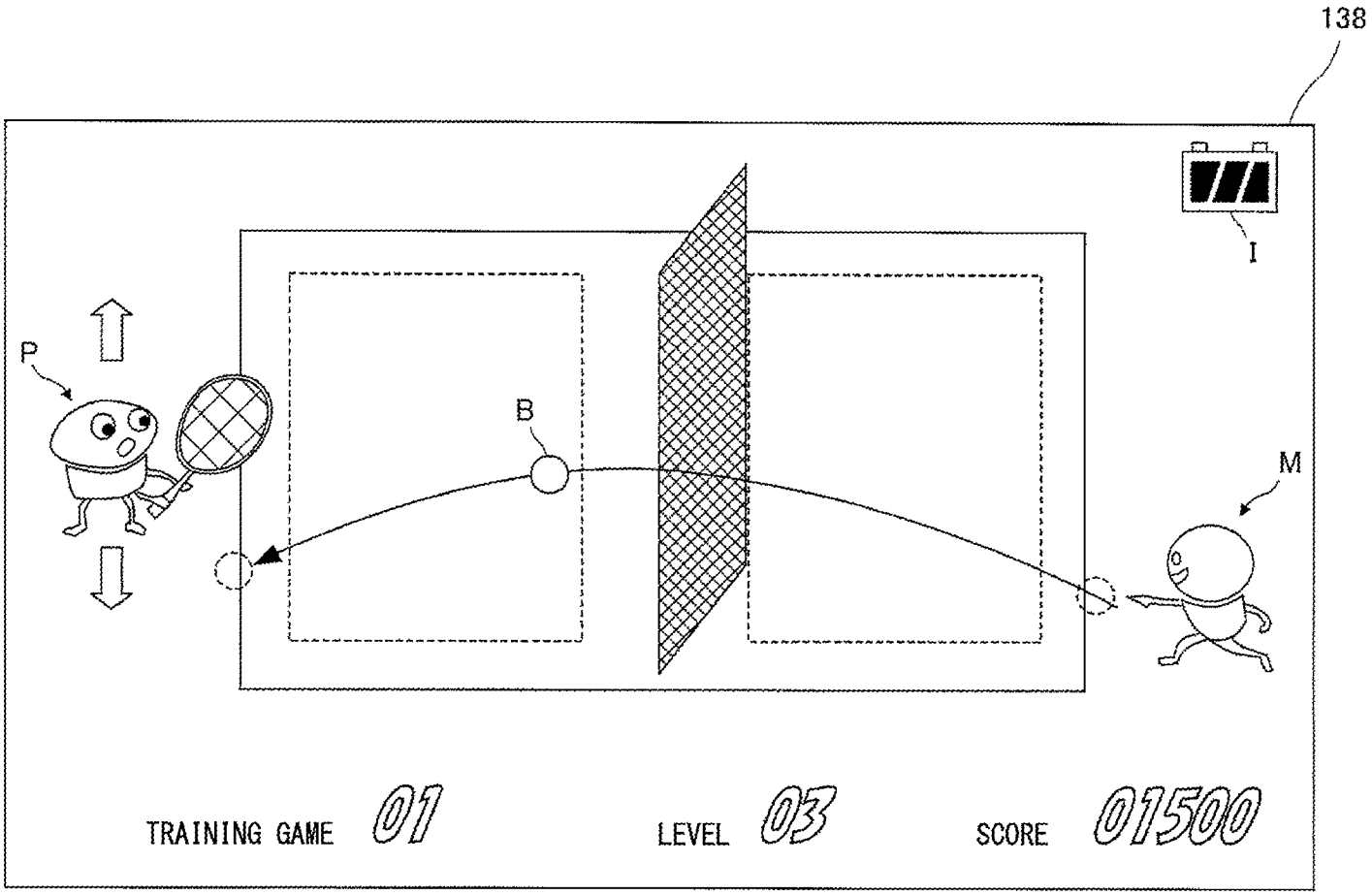
FIG. 4 is a diagram showing an example of a displayed video while a task is being carried out.

FIG. 4 is a diagram showing an example of a displayed video while a task is being carried out. FIG. 4 shows a video displayed on the display unit 138. The video shows a state in which a tennis-themed task game is selected from among a plurality of task games 215 and the selected task game is executed.

On the right side of a tennis court displayed at the center, a character M throwing a tennis ball B is superimposed on a background image. On the left side of the tennis court, a character P hitting the thrown tennis ball B is superimposed on the background image. The character M shows an operation of moving up and down and throwing the ball in accordance with the task given by the task game 215. The character P is a character representing the trainee 900. The character P shows an operation of moving up and down in accordance with the movement of the moving apparatus 120 and swinging a racket in response to an arrival of the tennis ball B. The tennis ball B moves back and forth between the right and left of the tennis court in accordance with the movement of the characters M and P.

Further, information indicating a situation of the game is also displayed. In the illustrated example, "Training Game 01" is displayed indicating that the "Tennis" game is selected from the task games 215, "Level 03" is displayed representing a difficulty level, and "Score 01500" is displayed representing a current score. The score is a numerical value given to the achievement of the task. For example, 100 points are added each time the tennis ball B is hit back. If the moving apparatus 120 did not return to the initial position, the points are reduced according to a distance of it from the initial position.

At the upper right of the screen, an icon I is displayed indicating the remaining capacity of the battery 129. The icon I changes according to the remaining capacity. Specifically, the overall control unit 210 receives a detection signal detected by the battery sensor 223 via the moving body control unit 220, generates a display signal for displaying the icon I according to a result of the detection, and transmits the display signal to the display control unit.

Figure 5A:
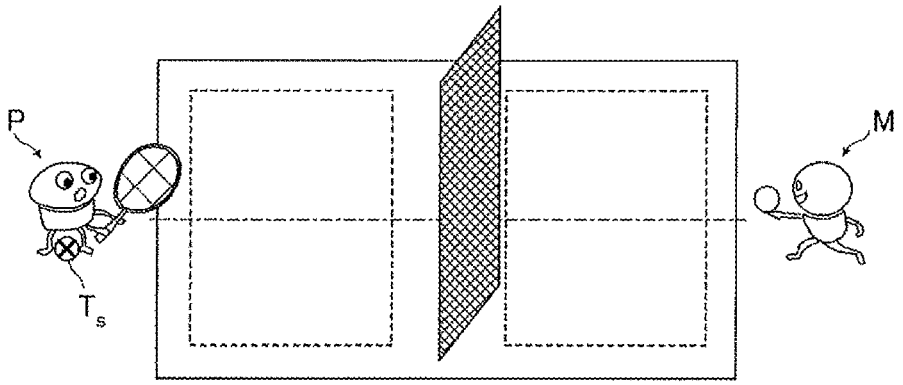
FIG. 5A is a diagram showing a transition of a displayed video while the task is being carried out.
Figure 5B:
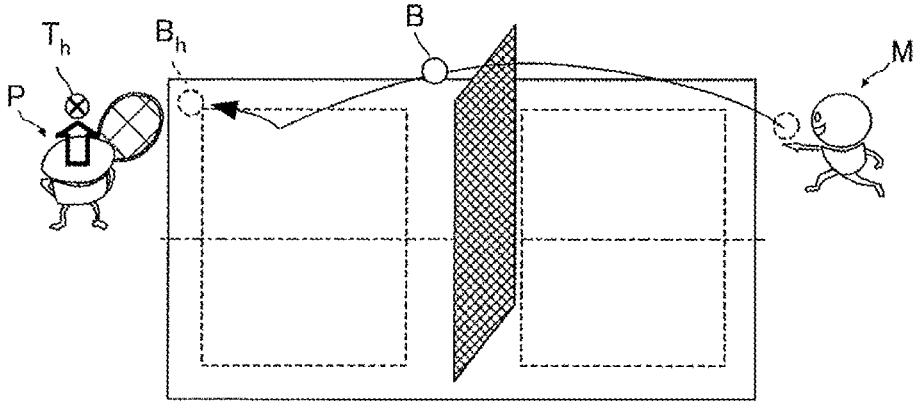
FIG. 5B is a diagram showing a transition of a displayed video while the task is being carried out.
Figure 5C:
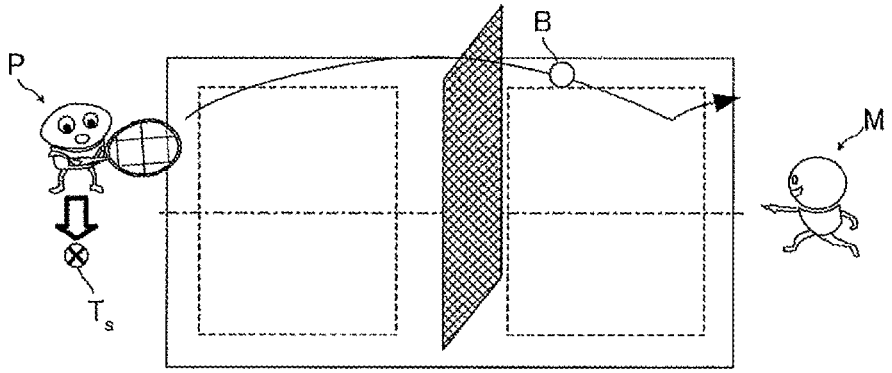
FIG. 5C is a diagram showing a transition of a displayed video while the task is being carried out.
Figure 6A:
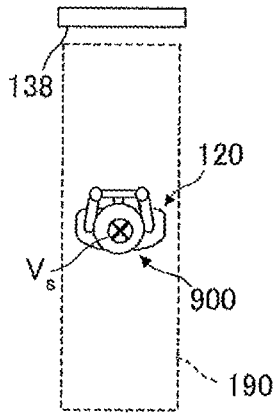
FIG. 6A is a diagram showing how the moving apparatus moves while a task is being carried out.
Figure 6B:
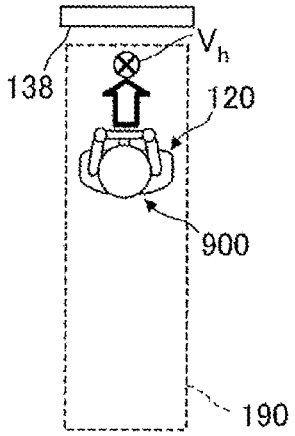
FIG. 6B is a diagram showing how the moving apparatus moves while the task is being carried out.
Figure 6C:
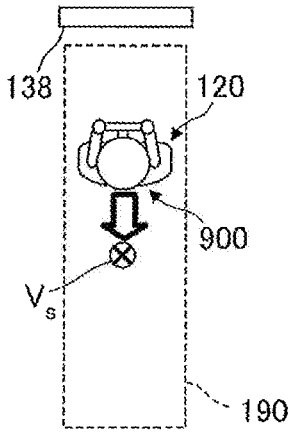
FIG. 6C is a diagram showing how the moving apparatus moves while the task is being carried out.

The task game 215 consecutively gives a plurality of tasks and lets the trainee 900 try to carry them out. In the case of the "tennis" game, one task is to hit the thrown tennis ball B once. Carrying out of this task will be described in more detail below. FIGS. 5A to 5C are diagrams showing the transition of the displayed video while the task is being carried out. Further, FIGS. 6A to 6C are diagrams in which the movements of the moving apparatus are observed from above the task. FIGS. 5A to 5C correspond to FIGS. 6A to 6C, respectively.

FIG. 5A shows a state immediately before the task is started, and the character P is positioned at the initial position Ts which is the middle in the vertical direction. The character M is positioned on the opposite side across the court with respect to the initial position Ts. FIG. 6A shows a state of the trainee 900 at this time. In this state, the moving apparatus 120 stays at the initial position Vs which is the center of the movement limited range 190. That is, the trainee 900 is waiting until the task is started.

As the trainee 900 is closely watching the display unit 138 on which the screen shown in FIG. 5A is displayed, the moving apparatus 120 travels forward when the moving apparatus 120 moves toward the display unit 138. Moreover, as the trainee 900 continues to closely watch the display unit 138 when the moving apparatus 120 moves away from the display unit 138, the moving apparatus 120 travels backward when it moves away from the display unit 138.

FIG. 5B shows a state immediately after the task is started, and the character M moves upward in the court to throw the tennis ball B so as to make the tennis ball B reach a target position Bh, which has been set for this task. Then, the tennis ball B moves along an illustrated trajectory. The speed at which the tennis ball B moves is determined in advance according to a level. Specifically, the higher the level, the faster the tennis ball B moves.

Before the tennis ball B reaches Bh, the trainee 900 moves the character P to a hitting position Th where the character P can hit back the tennis ball B at Bh. That is, as shown in FIG. 6B, the trainee 900 moves the moving apparatus 120 so that it travels forward to a target position Vh corresponding to the hitting position Th in the movement limited range 190.

If the character P can be moved to Th before the tennis ball B reaches Bh, the racket is swung when the tennis ball B arrives and the tennis ball B is hit back. FIG. 5C shows how the character P returns to the initial position Ts after hitting the tennis ball B. The trainee 900 moves the moving apparatus 120 so that it travels backward toward the initial position Vs as shown in FIG. 6C so as to return the character P to the initial position Ts before the tennis ball B reaches the right end of the court.

The task described with reference to FIG. 5A to FIG. 5C and FIGS. 6A to 6C is to let the trainee 900 move the moving apparatus 120 so that it travels forward from the initial position Vs to the target position Vh and then let the trainee 900 to move the moving apparatus 120 so that it travels backward to the initial position Vs while linking actions of the character P and the like displayed on the display unit 138 to those of the moving apparatus 120. Each task is defined by a distance to and a direction toward the target position Vh which the moving apparatus 120 is to be moved to. All of the tasks are managed by the task list.

FIG. 7 is a diagram for explaining the task list. The task list is stored in advance in the database 216 of the memory 214. As shown in FIG. 7, task numbers H1, H2, . . . and Hn are assigned to the respective tasks. In addition, distances D1, D2, . . . and Dn indicating distances from the initial position Vs to the target position Vh and the direction "+" or "−" toward the target position Vh are associated with the respective tasks. The direction "+" means that the target position Vh is positioned on the side of the display unit 138 with respect to the initial position Vs, while the direction "−" means that the target position Vh is positioned on the opposite side of the display unit 138 with respect to the initial position Vs. Therefore, if the task is in the direction "+", the trainee 900 moves the moving apparatus 120 so that it travels forward toward the target position Vh, while if the task is in the direction "−", the trainee 900 moves the moving apparatus 120 so that it travels backward toward the target position Vh.

The overall control unit 210 that executes the task game 215 generates a graphic video of the character M and the tennis ball B corresponding to the task to be executed and displays it on the display unit 138. For example, in a task number H3, a hitting position Th3 on the display screen corresponding to a target position Vs3, which is at a distance D3 in the "+" direction from the initial position Vs is calculated. Further, a target position Bh3 of the tennis ball B where the tennis ball B is hit when the racket is swung at the position Th3 is determined. Then, a trajectory of the tennis ball B reaching the target position Bh3 is calculated, and a graphic video in which the tennis ball B moves along the trajectory is generated and displayed on the display unit 138.

One task game is composed of k tasks randomly selected from the task list. The number k is changed according to the selected level. The higher the level, the more tasks selected. There may be a limitation on the selection of the tasks from the task list such that a task associated with a long distance will not be selected depending on the selected level.

Figure 8A:
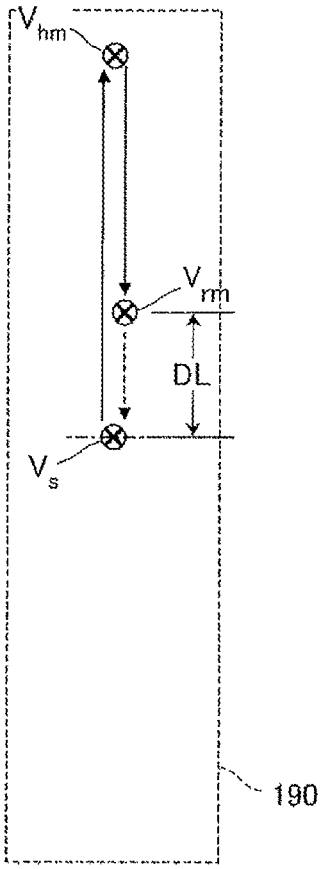
FIG. 8A is a diagram for explaining an example of task correction when there are tasks in the same direction.
Figure 8B:
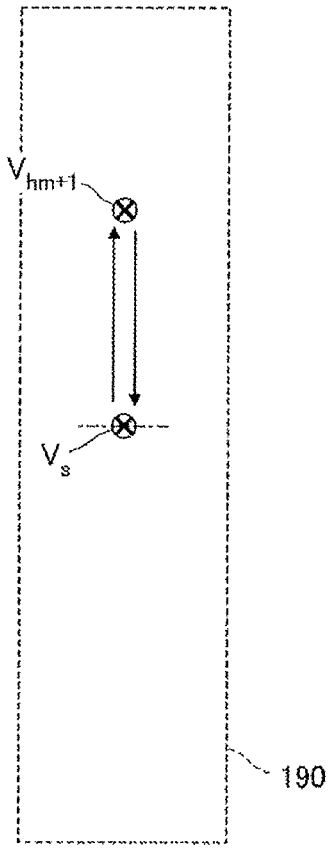
FIG. 8B is a diagram for explaining the example of task correction when there are tasks in the same direction.
Figure 8C:
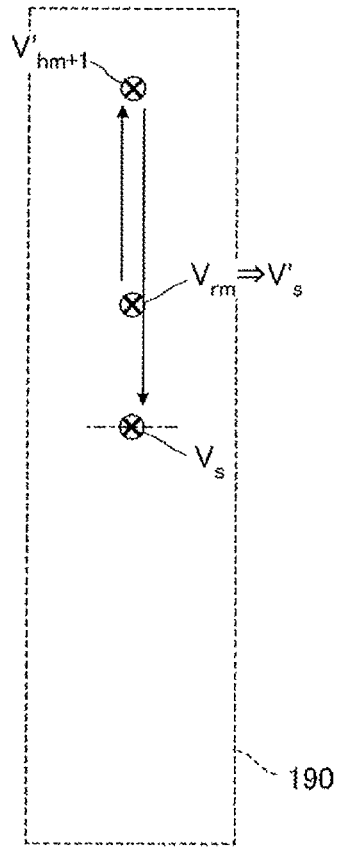
FIG. 8C is a diagram for explaining the example of task correction when there are tasks in the same direction.

Next, correction of the next task reflecting a result of trying to carry out the task that has been executed last when a plurality of tasks are consecutively executed will be described. FIGS. 8A to 8C are diagrams for describing an example of the task correction when there are consecutive tasks in the same direction.

FIG. 8A is a diagram showing an mth task Hm and a result of trying to carry out the task Hm. Here, the mth task Hm is a task executed immediately before a scheduled task. The task Hm is a task to travel back and forth from the initial position Vs to a target position Vhm that is away from the initial position Vs by a distance Dm in the + direction. A time limit Tm is a time set in advance according to a reciprocating distance 2Dm and the selected level. A speed at which the tennis ball B moves on the display screen is set according to this time limit Tm.

In FIG. 8A, an end position Vrm is an arrival position when the time limit Tm has elapsed. That is, it indicates that the trainee 900 should have returned the moving apparatus 120 to the initial position Vs by the time when the time limit Tm elapsed, but it turned out that the trainee 900 returned the moving apparatus 120 only to the end position Vrm. At this time, if a distance from the end position Vrm to the initial position Vs is DL, a distance DL is insufficient for a movement distance required by the task.

FIG. 8B is a diagram showing an m+1th task Hm+1 selected when the task game is started. Here, the m+1th task Hm+1 is a task scheduled immediately after the task Hm. The task Hm+1 is a task to travel back and forth from the initial position Vs to a target position Vhm+1, which is away from the initial position Vs by a distance Dm+1. A time limit Tm+1 is a time set in advance according to a reciprocating distance 2Dm+1 and the selected level.

Here, in the task Hm+1, the moving apparatus 120 is assumed to be positioned at the initial position Vs when execution of the task Hm+1 is started. However, the moving apparatus 120 is actually positioned at Vrm that is different from Vs. Therefore, if the task Hm+1 is executed without any correction, the distance to be actually moved to the target position Vhm+1 is shortened, and an expected training effect cannot be achieved. Therefore, in this embodiment, the initial position of the task Hm+1 is corrected to the end position Vrm, which is the position of the moving apparatus 120 at the end of the task Hm, and the target position Vhm+1 is also corrected according to this correction.

FIG. 8C is a diagram showing a corrected m+1th task H'm+1. As shown in FIG. 8C, the initial position V's of the task H'm+1 is set to Vrm, and V'hm+1 that is away from V's in the + direction by the distance Dm+1 is defined as a new target position. Here, the position to be returned to is not the corrected initial position V's but the original initial position Vs. By such setting, it is expected that the distance DL, which is insufficient when the task Hm is carried out, can be canceled out. A time limit T'm+1 is a newly set time according to a target movement distance 2Dm+1+DL and the selected level.

In FIGS. 8A to 8C, a case when there are consecutive tasks in the same direction has been described. That is, the movement directions of the tasks Hm and Hm+1 are "+". However, even when the movement directions of the tasks Hm and Hm+1 are "−", the task Hm+1 can be corrected similarly.

Figure 9A:
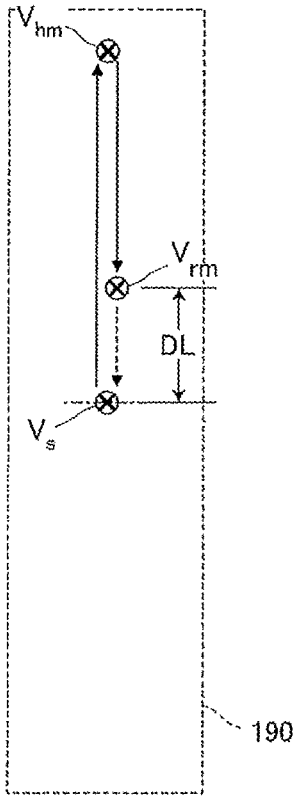
FIG. 9A is a diagram for explaining an example of task correction when there are tasks in different directions.
Figure 9B:
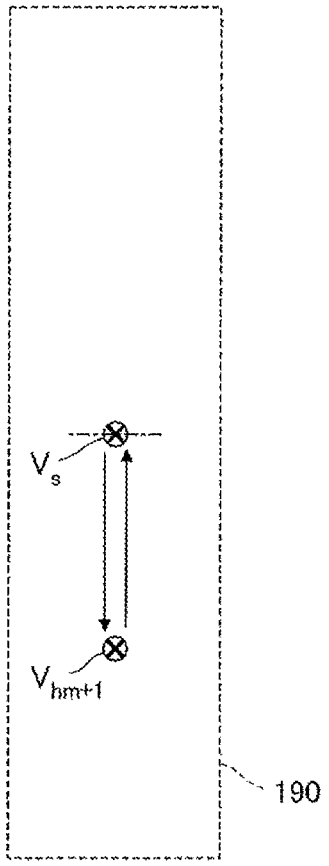
FIG. 9B is a diagram for explaining the example of task correction when there are tasks in different directions.
Figure 9C:
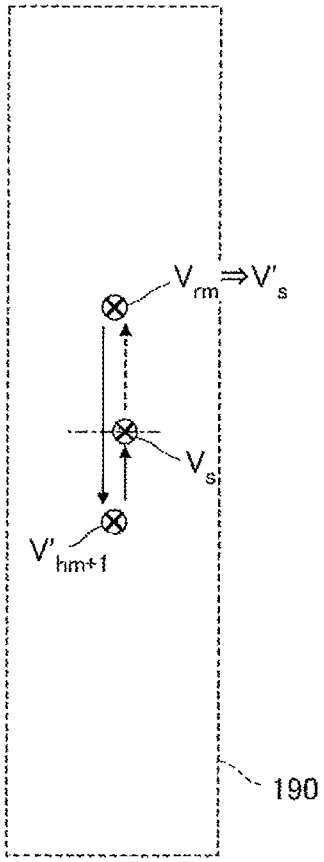
FIG. 9C is a diagram for explaining the example of task correction when there are tasks in different directions.

FIGS. 9A to 9C are diagrams for describing an example of task correction when there are consecutive tasks in different directions. FIG. 9A is a diagram showing an mth task Hm and a result of trying to carry out the task Hm. Here, in order to simplify the description, the same situation as in FIG. 8A is assumed.

FIG. 9B is a diagram showing an m+1th task Hm+1 selected when the task game is started. Here, the m+1th task Hm+1 is a task scheduled immediately after the task Hm. The task Hm+1 is a task to travel back and forth from the initial position Vs to a target position Vhm+1 which is away from the initial position Vs by a distance Dm+1 in − direction. A time limit Tm+1 is a time set in advance according to a reciprocating distance 2Dm+1 and the selected level.

Here, in the task Hm+1, the moving apparatus 120 is assumed to be positioned at the initial position Vs when execution of the task Hm+1 is started. However, the moving apparatus 120 is actually positioned at Vrm that is offset to the + side from Vs. Therefore, if the task Hm+1 is executed without any correction, the distance to be actually moved to the target position Vhm+1 becomes too long, possibly making it impossible to reach the target position in the end. In particular, when the movement directions of the tasks Hm and Hm+1 differ from each other, the trainee 900 may have to move the moving apparatus 120 more than or equal to half the movement limited range 190 depending on the target position Vhm+1 of the task Hm+1. Under such circumstances, due to the performance limit of the moving apparatus 120, the moving apparatus 120 may not be able to travel back and forth to such a target position within a time limit in the first place.

If the trainee 900 cannot achieve the task, he/she may be less motivated to do the task, and thus an expected training effect may not be achieved. Therefore, in this embodiment, as in the case where there are consecutive tasks in the same direction, which is described with reference to FIGS. 8A to 8C, the initial position of the task Hm+1 is set to an end position Vrm, which is the position of the moving apparatus 120 at the end of the task Hm, and the target position Vhm+1 is corrected according to this correction.

FIG. 9C is a diagram showing a corrected m+1th task H'm+1. As shown in FIG. 9C, an initial position V's of the task H'm+1 is set to Vrm, and V'hm+1 that is away from V's in the − direction by a distance Dm+1 is set as a new target position. Here, the position to be returned is not the corrected initial position V's but is the original initial position Vs. By such setting, the target movement distance in the task H'm+1 is 2Dm+1−DL. Thus, in addition to the distance DL that is insufficient when the task Hm is carried out, a distance 2DL is insufficient for the original target movement distance. This insufficiency may be canceled out by correcting another task to be given later or by adding a task corresponding to the insufficiency to k tasks that are selected when the task game is started. Here, the time limit T'm+1 is a time newly set according to the target movement distance 2Dm+1-DL and the selected level.

In FIGS. 9A to 9C, a case when there are consecutive tasks in the different directions has been described. That is, the movement direction of the task Hm is "+", and the movement direction of the task Hm+1 is "−". However, even when the movement direction of the task Hm is "−", and the movement direction of the task Hm+1 is "+", the task Hm+1 can be corrected similarly.

Figure 10:
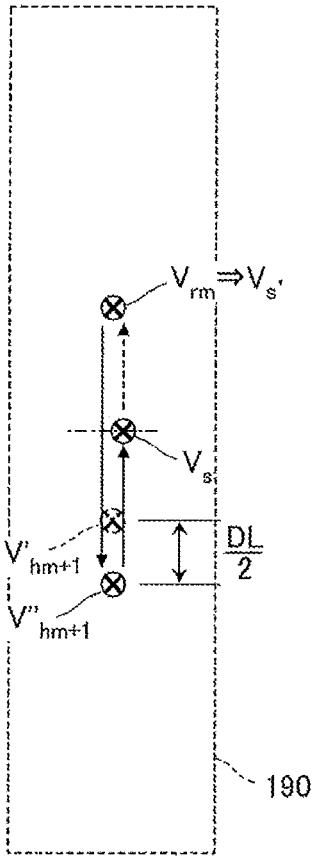
FIG. 10 is a diagram for describing a modified example of task correction.

FIG. 10 is a diagram for describing a modified example of the task correction of FIG. 9C. As the preconditions are the same as those in FIG. 9A and FIG. 9B, descriptions thereof are omitted.

The target movement distance of the corrected task H'm+1 shown in FIG. 9C is shorter by the distance DL from the target movement distance 2Dm+1 of the original task Hm+1. Therefore, in this modified example, the distance Dm+1 from the corrected initial position V's to the target position is increased based on the distance DL that is insufficient when the task Hm is carried out in order to compensate for this insufficiency. That is, V"hm+1, which is farther than the corrected target position V'hm+1 in FIG. 9C, is set as a new target position. In particular, as shown in FIG. 10, by correcting V"hm+1 to a position farther than V'hm+1 by DL/2, the corrected target movement distance can be made equal to the target movement distance 2Dm+1 of the original task Hm+1. By correcting the target position in this way, it is possible to reduce the insufficiency for the amount of training assumed when the task game is started. Further, there is no possibility of setting a target position that is beyond the capability of the moving apparatus 120.

Figure 11A:
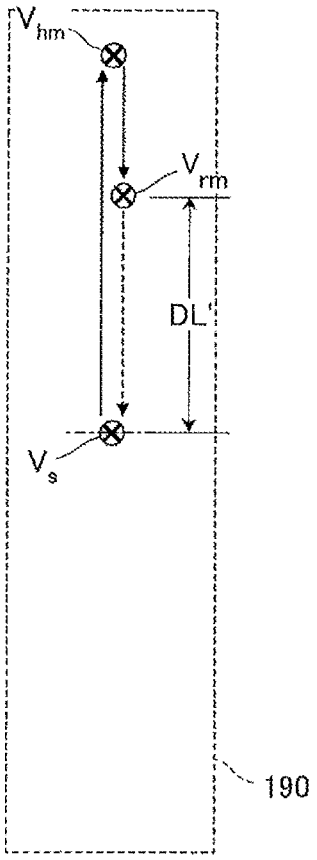
FIG. 11A is a diagram for describing another modified example of task correction.
Figure 11B:
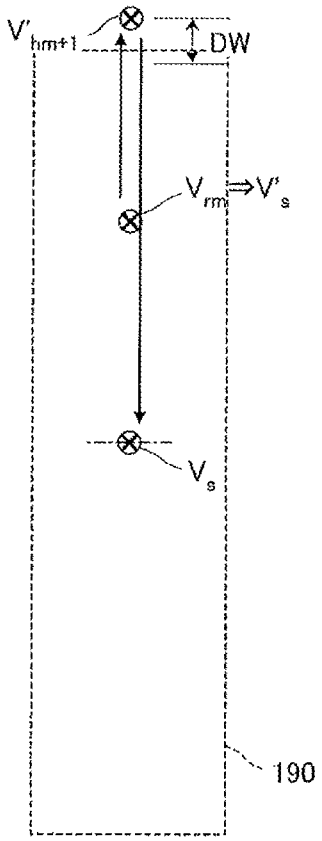
FIG. 11B is a diagram for describing another modified example of task correction.
Figure 11C:
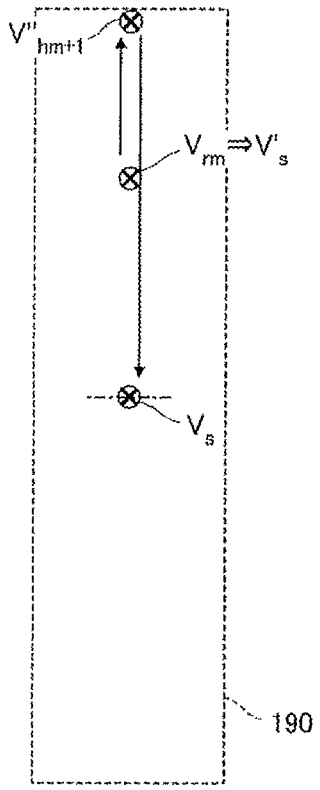
FIG. 11C is a diagram for describing another modified example of task correction.

FIGS. 11A to 11C are diagrams for described another modified example of the task correction. FIG. 11A is a diagram showing an mth task Hm and a result of trying to carry out the task Hm. The task Hm in FIG. 11A is the same as the task Hm in FIG. 8A except that, as a result of the carrying out by the trainee 900, an end position Vrm reached when a time limit Tm has elapsed is closer to a target position Vhm than in the case of FIG. 8A. That is, an insufficiency DL' is greater than the distance DL in the case of FIG. 8A.

In this case, if an m+1th task Hm+1 selected when the task game is started is the same as the task Hm+1 of FIG. 8B, when the same task correction as in FIG. 8C is applied, a corrected target position V'hm+1 is positioned outside the movement limited range 190 as shown in FIG. 11B. A distance projecting from the movement limited range 190 at this time is defined as DW. In this way, when the target position is outside the movement limited range 190, the moving apparatus 120 cannot reach the target position in the first place.

Therefore, in this modified example, when the corrected target position V'hm+1 is positioned outside the movement limited range 190, as shown in FIG. 11C, an edge of the movement limited range 190 is set as a new target position V"hm+1. A target movement distance of a task H"m+1 when the target position is corrected in this manner is 2Dm+1+DL'-2DW. Thus, a time limit T"m+1 is newly set according to the target distance and the selected level. Note that due to such task correction, an insufficiency is generated for the movement distance assumed when the task game is started. However, this insufficiency may be canceled out by correcting another task to be provided later. Alternatively, this insufficiency may be canceled out by adding a task corresponding to the insufficiency to k tasks that are selected when the task game is started.

Figure 12:
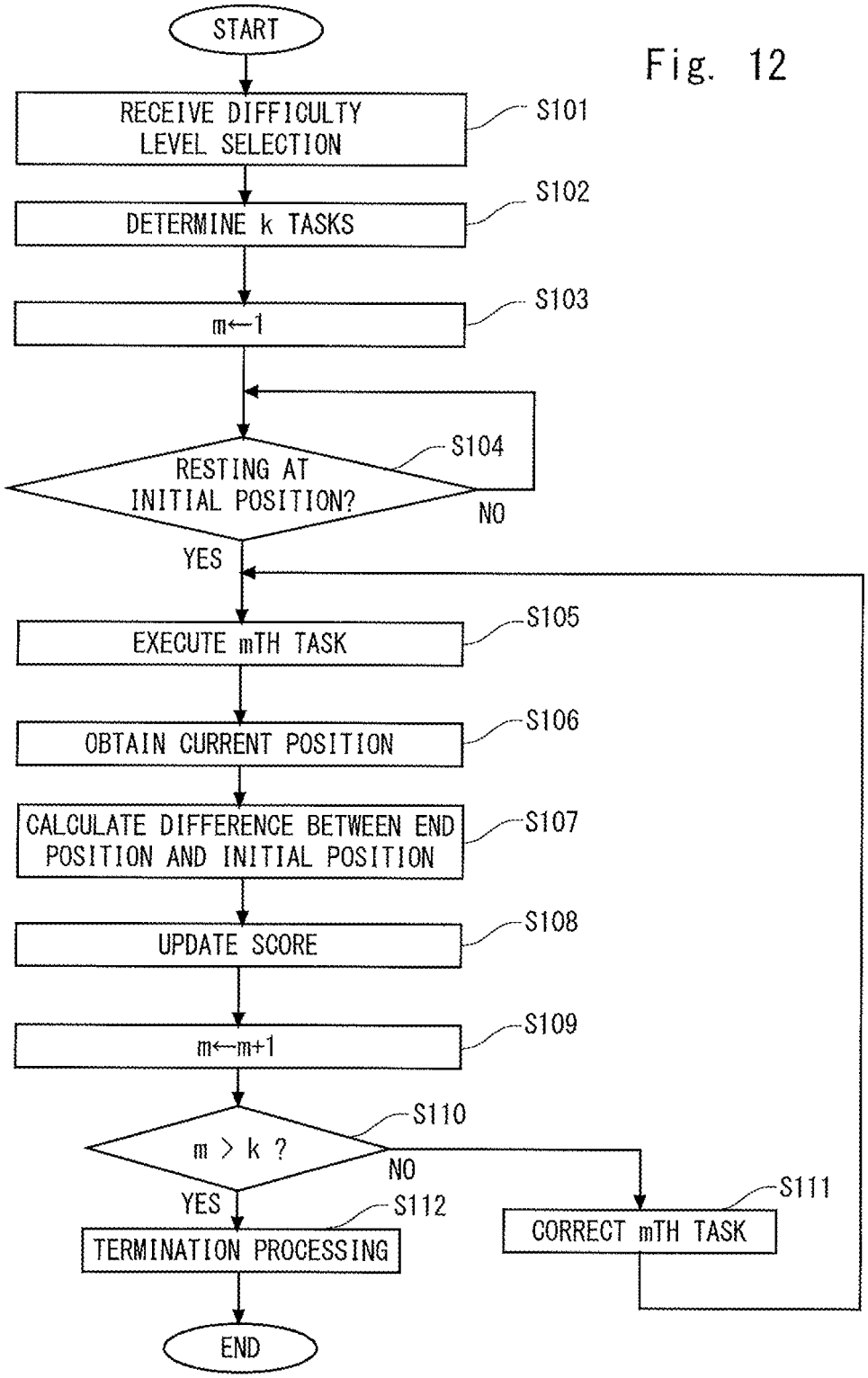
FIG. 12 is a flowchart showing processing from start to end of one task game.

FIG. 12 is a flowchart showing processing from start to end of one task game. The flow starts from when the trainee 900 or the operator activates the training apparatus 100. In this example, it is assumed that the overall control unit 210 selects and reads the game of "tennis" from the task games 215 in the memory 214 and then executes the selected game at the same time as the activation.

In Step S101, the overall control unit 210 receives a selection of the difficulty level from the trainee 900 or the like via the operation reception unit 211. Then, in Step S102, the task list is read out from the database 216, and k tasks corresponding to the received difficulty level are randomly selected. When a high difficulty level is selected, the overall control unit 210 increases the number k as compared with a case where a low difficulty level is selected. Additionally, when a high difficulty level is selected, an allowable time limit for the target distance is reduced.

The overall control unit 210 proceeds to Step S103 where it sets a count variable m to 1. Then, the overall control unit 210 proceeds to Step S104 where it monitors an output of the position sensor 113 and evaluates as to whether or not the moving apparatus 120 has reached the initial position Vs and has been brought to rest. If the overall control unit 210 evaluates that the moving apparatus 120 has not been brought to rest, it waits until the moving apparatus 120 is brought to rest. If the overall control unit 210 evaluates that the moving apparatus 120 is brought to rest, the process proceeds to Step S105.

When the overall control unit 210 proceeds to Step S105, it executes the task Hm scheduled for the mth task among the tasks determined in Step S102. Specifically, as described with reference to FIGS. 5A to 5C and FIGS. 6A to 6C, the character P representing the trainee 900 is superimposed on an image showing a progress of the task Hm at a position corresponding to the position of the moving apparatus 120 and displayed on the display unit 138.

When the time limit Tm of the task Hm has expired, the overall control unit 210 proceeds to Step S106 where it obtains the detection signal of the position sensor 113 and checks the current position of the moving apparatus 120. The checked current position is the end position Vrm of the task Hm. Then, the overall control unit 210 proceeds to Step S107 where it calculates a difference between the end position Vrm and the initial position Vs. The overall control unit 210 calculates a score given to the achievement of the task Hm based on this difference and updates the cumulative score displayed on the display unit 138. The score given to the achievement of the task Hm is adjusted in such a way that the greater the difference between the end position Vrm and the initial position Vs, the more the score is reduced.

The overall control unit 210 proceeds to Step S109 where it increments the count variable m. Then, in Step S110, the incremented count variable m is compared with the number k of the tasks. If the overall control unit 210 evaluates that the count variable m has not exceeded k, it proceeds to Step S111, while if the overall control unit 210 evaluates that the count variable m has exceeded k, it proceeds to Step S112.

When the overall control unit 210 proceeds to Step S111, it corrects the initial position and the target position of the task Hm corresponding to the incremented m in accordance with the example described with reference to FIGS. 8A to 11C. When the correction is completed, the overall control unit 210 proceeds to Step S105 to execute the corrected task. The task executed in Step S105 is the corrected task.

When the overall control unit 210 proceeds to Step S112, it executes termination processing and ends the series of flow. The termination processing is a process of displaying the determined score on the display unit 138 and updating history information of the training that has been executed so far.

By such a processing flow, it is possible to maintain the trainee 900's motivation for carrying out the task and expect a high training effect.

Figure 13:
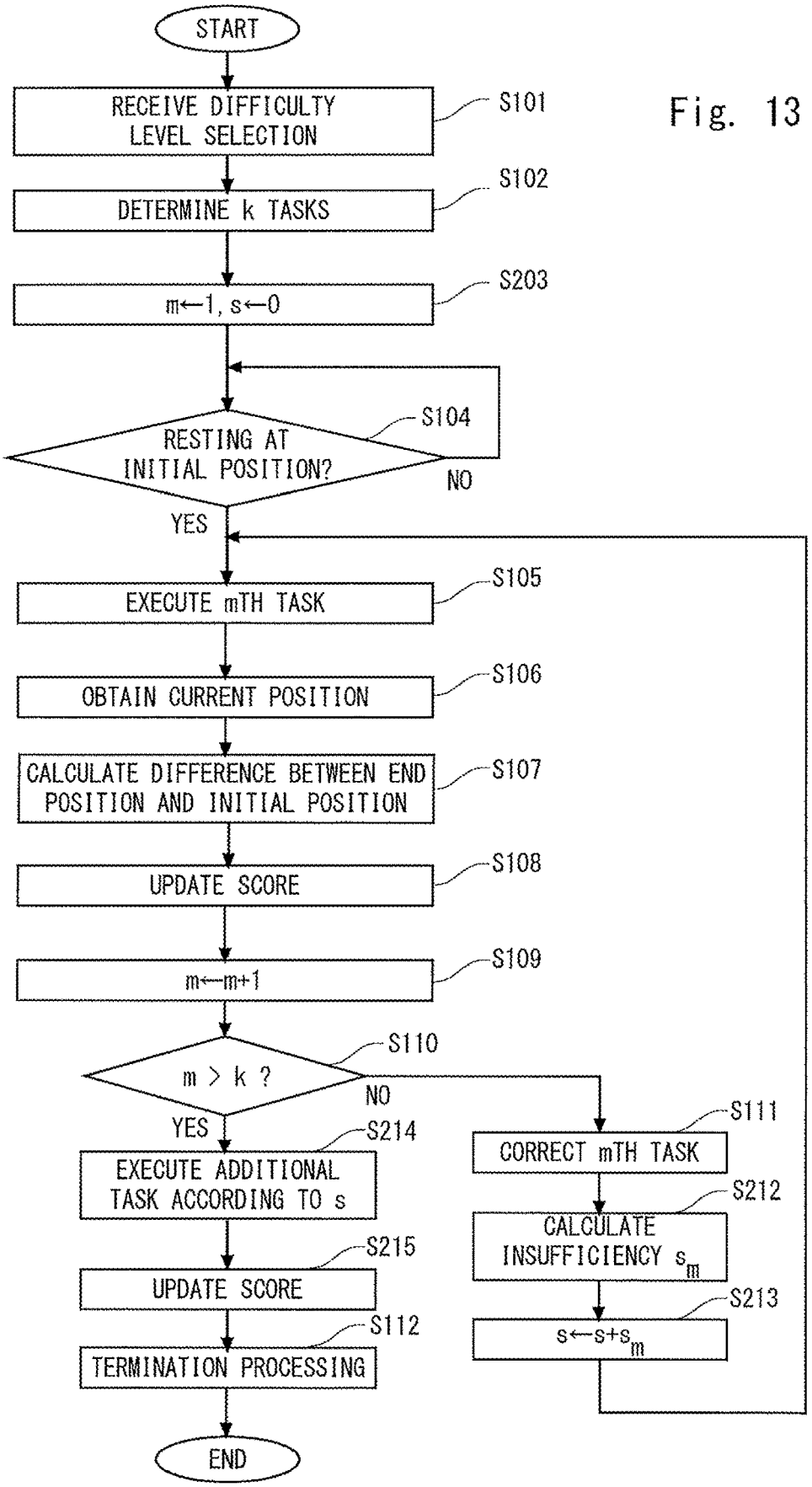
FIG. 13 is a flowchart showing processing of one task game in another example.

FIG. 13 is a flowchart showing processing of one task game in another example. The same processing as that in FIG. 12 is denoted by the same step numbers, and the description thereof will be omitted.

When Step S102 is completed, the overall control unit 210 proceeds to Step S203. In Step S203, the count variable m is set to 1, and an accumulated variable s for accumulating the insufficiencies that could be generated in each task is reset.

When the mth task is corrected in Step S111, the overall control unit 210 proceeds to Step S212. In Step S212, the overall control unit 210 calculates an insufficiency sm for the movement distance determined by the correction of the task m. In this calculation, the difference between the end position Vrm and the initial position Vs that is short as a result of trying to carry out the task that has been executed last is taken into consideration. The overall control unit 210 proceeds to Step S213 where it adds the calculated sm to the accumulated variable s accumulated so far and updates s.

When the overall control unit 210 evaluates that the count variable m exceeds the number k of tasks in Step S110, it proceeds to Step S214 to determine and execute an additional task according to the value of the integrated variable s. Specifically, a task is selected from the task list as an additional task and executed. In this task list, a distance D substantially equal to the value of the accumulated variable s is defined. If the accumulated variable s is large, the additional task may be divided into a plurality of tasks to be executed.

When execution of the additional task is completed, the overall control unit 210 proceeds to Step S215. In Step S215, the overall control unit 210 calculates a score given to the achievement of the additional task and updates the cumulative score to be displayed on the display unit 138. Then, the overall control unit 210 executes the termination processing in Step S112 to end the series of flow.

By such a processing flow, it can be expected to achieve an amount of training close to an amount of training expected when the task game is started. Note that the measure for compensating the amount of movement of the moving apparatus 120 in each task determined when the task game is started is not limited to the example of this processing flow. As in the example of this processing flow, in addition to adjusting the load of the trainee 900 to be greater by setting an additional task later according to the insufficiency, the load on the trainee 900 may be adjusted to be greater in the task to be executed next which has been set when the task game is started. In this case, the target distance may be increased or the target distance may remain unchanged and the time limit for achieving the task may be shortened. Alternatively, the target distance may be increased and the time limit may be shortened. Either way, when the insufficiency is generated in a target reciprocating movement distance of a certain task among tasks given consecutively in one task game due to the correction of the initial position, the overall control unit 210 compensates for the insufficiency. The insufficiency may be compensated in any way as long as it makes an adjustment in such a way that the load of the trainee 900 is increased in a task executed after a task in which the insufficiency is generated among tasks given consecutively in the task game.

In this embodiment described above, when the end position Vrm of the task Hm does not match the initial position Vs, the task Hm+1 to be executed next is corrected. However, if a distance between Vrm and Vs is less than or equal to a predetermined distance, the task Hm+1 may not be corrected. By simplifying the processing in this manner, the load on the overall control unit 210 can be reduced.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A balance training apparatus operating in conjunction with an inverted pendulum moving apparatus on which a trainee rides and performs a moving operation, the balance training apparatus comprising:

a detector configured to detect a position of the moving apparatus; and a controller configured to set a task for the trainee to travel back and forth from an initial position to a target position within a predetermined time and configured to display, on a display, a character representing the trainee at a position corresponding to a position of the moving apparatus superimposed on a video indicating progress of the task, wherein the controller corrects an initial position of a task to be executed next to a position of the moving apparatus at the end of a task that has been executed last and corrects the target position according to the correction of the initial position.

2. The balance training apparatus according to claim 1, wherein when there is an insufficiency in a reciprocating movement distance targeted by the task due to the correction of the initial position, the controller makes an adjustment in a task executed after the task in which the insufficiency is generated from among the tasks consecutively given in one task game in such a way that a load on the trainee will become large.

3. The balance training apparatus according to claim 1, wherein the controller adjusts a score given to achievement of the task based on the correction of the initial position and displays the score on the display.

4. The balance training apparatus according to claim 1, wherein when the position of the moving apparatus at the end of the task that has been executed last is within a predetermined distance from the initial position, the controller does not correct the initial position of the task to be executed next.

5. A control method of a balance training apparatus operating in conjunction with an inverted pendulum moving apparatus on which a trainee rides and performs a moving operation, the control method comprising:

setting a first task and a second task for the trainee to travel back and forth from an initial position to a target position within a predetermined time;

displaying, on a display, a character representing the trainee at a position corresponding to a position of the moving apparatus superimposed on a video indicating progress of the first task after the first task is started; and correcting the initial position in the second task to a position of the moving apparatus at the end of the first task and correcting the target position in the second task according to the correction of the initial position.

* * * * *